US007316046B2

(12) United States Patent
Michaels et al.

(10) Patent No.: US 7,316,046 B2
(45) **Date of Patent: *Jan. 8, 2008**

(54) CLEANING BRUSH WITH DISPOSABLE/REPLACEABLE BRUSH HEAD

(75) Inventors: Kenneth W. Michaels, Spring Grove, IL (US); Peter M. Neumann, Racine, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/702,908

(22) Filed: Nov. 6, 2003

(65) Prior Publication Data

US 2005/0097694 A1 May 12, 2005

(51) Int. Cl.
*A47L 25/00* (2006.01)
*A47L 15/00* (2006.01)

(52) U.S. Cl. ..... 15/210.1; 15/209.1; 15/229.1

(58) Field of Classification Search ..... 15/228, 15/229.1, 229.2, 229.6, 229.11, 229.13, 209.1, 15/210.1, 147.1, 150, 223, 224, 226
See application file for complete search history.

(56) References Cited

U.S. PATENT DOCUMENTS

| | | | | |
|---|---|---|---|---|
| 245,585 | A | 8/1881 | Tracy | |
| 297,067 | A * | 4/1884 | Cornelius | 15/150 |
| 1,182,786 | A * | 5/1916 | Morrison | 15/147.1 |
| 1,631,791 | A | 6/1927 | Buckley | |
| 1,993,215 | A | 3/1935 | Hoyt et al. | |
| 2,290,894 | A | 7/1942 | Rivanov | |
| 2,318,094 | A | 5/1943 | Petzoid, Jr. et al. | |
| 2,514,496 | A * | 7/1950 | Jones et al. | 15/223 |
| 2,755,497 | A | 7/1956 | Greacen, Jr. | |
| 3,383,158 | A * | 5/1968 | Leland | 401/201 |
| 3,496,616 | A | 2/1970 | Vazquez | |
| 3,605,161 | A * | 9/1971 | Moss et al. | 15/150 |
| 3,789,451 | A | 2/1974 | Laitner | |
| 3,795,934 | A * | 3/1974 | Moss | 15/229.2 |
| 4,015,305 | A * | 4/1977 | Komatsu | 15/150 |
| 4,031,673 | A | 6/1977 | Hagelberg | |
| 4,755,421 | A | 7/1988 | Manning et al. | |
| 4,964,186 | A | 10/1990 | Stuck | |
| 5,630,243 | A | 5/1997 | Federico et al. | |
| 5,970,567 | A | 10/1999 | Hirse | |
| 6,094,771 | A | 8/2000 | Egolf et al. | 15/210.1 |
| 6,745,427 | B1 * | 6/2004 | Trenz et al. | 15/104.94 |
| 2001/0055926 | A1 | 12/2001 | Fereshtehkhou et al. | 442/96 |
| 2003/0074757 | A1 | 4/2003 | Brinker | |
| 2004/0129296 | A1 * | 7/2004 | Treacy et al. | 134/6 |
| 2005/0005378 | A1 * | 1/2005 | Soller et al. | 15/104.94 |

FOREIGN PATENT DOCUMENTS

| | | | |
|---|---|---|---|
| GB | 886285 | * | 1/1962 |
| GB | 889235 | | 2/1962 |
| GB | 23293325 | | 9/2001 |

* cited by examiner

*Primary Examiner*—Laura Guidotti

(57) ABSTRACT

Disclosed are brushes for cleaning toilet bowls and the like. The brushes have a permanent handle and can be used with a replaceable/disposable brush head that is flushable after use. The brush is a stack of sheets of water-dissolvable material. The sheets are compressed to both bind them together into a stack and create axial/longitudinal undulations. A wand provides a remote system for clamping and unclamping the brush head. The wand has a jaw whose mouth has corresponding undulating configurations. A side opening in the jaw may also be provided to facilitate assembly, as may a rear catch portion on the brush head.

2 Claims, 7 Drawing Sheets

CLEANING BRUSH WITH DISPOSABLE/REPLACEABLE BRUSH HEAD

CROSS-REFERENCE TO RELATED APPLICATIONS

Not applicable.

STATEMENT REGARDING FEDERALLY SPONSORED RESEARCH

Not applicable

FIELD OF THE INVENTION

The present invention relates to brushes that are used for cleaning. It appears particularly well suited for providing improved toilet brushes.

BACKGROUND OF THE INVENTION

Toilet brushes are typically used to swirl cleaning chemicals around a toilet bowl and then to scrub the sides of the bowl with those chemicals and water, so as to assist in removing stains along the bowl sides. Such brushes usually have brush bristles that are permanently affixed to the handle of the brush.

After using such brushes a consumer will typically attempt to rinse off the brush by swirling it in the bowl water. This rinsing process may be repeated through one or more additional rinsing flushes. While this may rinse off most of the cleaning chemicals, feces, urine, and stray bits of paper typically found in the toilet, the brushes still normally retain some contaminants even after extensive rinsing. As a result, such brushes can develop an unpleasant smell or appearance during storage.

Regardless, such brushes will be dripping wet immediately after use. The consumer sometimes will therefore shake the brush over the toilet to try to remove most of the excess water, and then quickly move the brush into a storage bucket. This can result in some liquid being splashed or dripped on the floor. In any event, a storage place for the brush is needed between uses where drippings can collect.

The art therefore designed toilet brushes where permanent brush handles were provided, but the brush heads were formed as disposable and replaceable elements. See e.g. U.S. Pat. Nos. 2,755,497, 4,031,673, 5,630,243, and 6,094,771. See also GB 2,329,325. These brushes were designed so that a small replaceable head could be flushed down the toilet after each use. Some such heads were impregnated with a cleaning composition to avoid the need to separately add a cleaning chemical.

However, these devices typically relied on relatively weak frictional attachments to connect the replaceable brush head to the wand/handle. The head would therefore sometimes accidentally/prematurely fall off during use (before the cleaning was complete, such as during vigorous scrubbing of a stubborn stain).

Also, certain types of such brush heads could cause clogging problems, or be otherwise unsuitable for use with sensitive septic systems. This might be due to the size of the head, or to extra structures (such as cardboard bands) used to hold head parts together.

In other prior art devices, some formed their disposable brush heads from highly water-degradable material. Unfortunately, because the material they chose for the head was so water-degradable it sometimes would begin to fall apart before the cleaning process was completed, particularly when aggressive scrubbing was attempted. Further, such material was so flexible that it made it difficult to transmit scrubbing force from the handle to the brush head portion without risking the handle scratching the bowl sides.

Still other brush assemblies of this type required the consumer to provide a continuous pressure to keep the head in contact with the wand. See e.g. U.S. Pat. Nos. 1,631,791 and 2,290,894. This could lead to hand strain, and in some cases to premature release of the head.

Still other such brushes were difficult to assemble or disassemble. See e.g. U.S. Pat. No. 245,585.

Still other devices of this type could not be produced efficiently with automated equipment. With those, the cost of the devices was such as to make them less competitive in the marketplace.

In GB 2,329,325 there was disclosed a toilet brush with a head portion made of a stack of bound sheets of water-dissolvable material. However, this relied on an undesirable adhesive feature, and in any event had other undesirable characteristics.

A number of other prior brush heads had their bristles spread too quickly under brushing force, making scrubbing somewhat more difficult than optimal. Still other brush heads had other deficiencies.

Thus, a need continues to exist for improved toilet brushes having replaceable brush heads.

SUMMARY OF THE INVENTION

In one aspect the invention provides a cleaning implement having a handle with a clamping jaw, and a brush head formed from a stack of material so as to be suitable to be held in the jaw. The brush head has a series of undulations extending along a longitudinal axis of at least one of its top or bottom surfaces, and the jaw has a mouth having means to secure the brush head and inhibit side-to-side movement of the brush head in the mouth.

Preferably, these means are a series of essentially parallel openings extending along a longitudinal axis of the jaw which are separated by at least one narrowed linking opening, the brush head is formed from a stack of water-degradable material, and the cleaning implement is a toilet brush.

In other preferred forms the undulations extend along a longitudinal axis of the brush head, beginning at a rearward end of the brush head, or the undulations extend along a longitudinal axis of the brush head, beginning adjacent, but not at, the rearward end of the brush head. In this latter version the brush head is formed with a thickened rearward end, a narrowed middle portion having said undulations, and a front flowerable end.

In still other preferred forms the undulations were formed by compressing the stack, and the compression of the stack also served to bind an end of the stack together. If desired, a plurality of the layers can be formed with bristle segments adjacent a forward end of the stack.

In another aspect the invention can provide a brush head suitable to be held by a cleaning implement. The brush head has a plurality of layers of a water-degradable material positioned on top of each other in the form of a stack of such layers. At least one of a top or bottom side of the stack is provided with undulations.

In yet another form the invention provides wand for holding a brush head. The wand has a handle having an internal axial cavity, a lower opening communicating with the cavity, and an activator opening, an actuator having a projection extending through the activator opening, a connecting rod linked to the projection which is mounted in the handle cavity, and a jaw linked to the rod which extends out the handle lower opening.

The jaw has a throat portion and a clamping portion, the clamping portion, when in its clamping position, presenting a series of openings separated by at least one narrowed linkage. The wand is constructed and arranged such that a first movement of the projection will move the jaw to a first position suitable to release a brush head if the brush head has been inserted in the jaw, and a second movement of the projection will move the jaw to a second position suitable to clamp a brush head if a brush head has been inserted in the jaw.

In other preferred forms the jaw is provided with a side cheek opening connected to the jaw's throat, and the wand is for holding a toilet brush head.

Water-degradability is a desirable feature because it allows the head to be flushed immediately after use, thereby avoiding the need to transport the dripping head to a garbage can, and avoiding any odors that may develop if the brush head were left in a garbage can for some time period after use. Preferred water-degradability exists where with the degree of mechanical action typical in residential plumbing systems, the material will structurally separate in water into numerous small pieces in a short period.

For purposes of interpreting our claims, we use a standard laboratory test, rather than observing the particular material in a plumbing facility. In this regard, we agitate a standard sample of the material in a tube containing water, by repetitively inverting the tube at a standard speed.

We obtain a transparent tube (e.g. a plastic tube) that is 500 mm in height with an internal diameter of 73 mm. We place in the tube 700 ml of tap water at 23° C. A 100 mm×100 mm sample of the material to be tested (regardless of thickness) is placed in the water and allowed to stand immersed for 30 seconds. During the 30 seconds the tube is stoppered.

The tube is then inverted (rotated 180 degrees), stopped for a second, turned back to the original starting position (180 degrees), and then stopped for a second. Note the reversal of direction, rather than continued rotation in the same direction which might create a centrifugal force which forces the material to a wall. Each cycle takes about four seconds, leading to an average test speed of 15 such cycles per minute.

We then examine whether within five minutes of such agitation the material has at least split into two pieces. If so, the material is considered "water-degradable" for purposes of our claims. Note that it is highly preferred that the material be chosen so that under these conditions, within that five minutes, the material will have broken up into many small pieces. Note that "water-degradable" is not being used in this application in a way that necessarily requires any particular degree of biodegradability (as distinguished from structural degradability under the conditions specified). Of course, for a variety of reasons, biodegradability may well be desirable as well.

While a variety of cellulosic materials have been developed for use as toilet paper, and most toilet papers are water-degradable, stacked plies of conventional toilet paper would not be optimal for these brush heads as such paper is typically designed to degrade much more quickly than desired when used for cleaning bowl sides. It is instead preferred to use a nonwoven fibrous web formed from a blend of cellulosic fibers that are hydroentangled. See U.S. Pat. No. 4,755,421 for a disclosure of such hydroentangled materials.

It is most preferred to use a nonfibrous web which is at least 70% pulp fibers hydroentangled with other selected fibers. Suitable materials are available from Ahlstrom Corporation under the tradenames Hydraspun 784 Flushable Wipes, Hydraspun 8553 Flushable Wipes, Hydraspun 1280 Flushable Wipes, and Hydraspun 1280 Flushable Wipes Apertured Grade. The last of these materials is a somewhat more abrasive material than the other three.

One could one start with a material having a dry thickness of about 500 microns. By forming a two-ply structure of that material one could end up with a thickness of about 1,000 microns.

The brush heads of the present invention could be formed from a single piece of water-degradable material that has been repetitively folded back on itself in accordion fashion. This is one form of a "stack" of material.

Another approach is to take shorter segments of that material, fold them over once (or not at all), and then stack the segments. Either approach creates a stack brush head.

In any event, it is preferred to have between four and forty layers of such material in the stack. Using less than four layers may provide too small a brush head (which takes longer to clean a typical toilet bowl), or require each sheet to be so thick as to be less degradable. Using more than forty layers increases the production cost and (depending on the thickness of the layers) may increase the frequency of clogging the toilet or problems in the septic system. To achieve any desired level of thickness of a particular layer, one can start with a sheet that is already that thick, or take multiple sheets of less thickness and (by pressing) create a multiple ply layer.

To provide for easier handling, clamping and removal of the brush head, the end of the brush head opposite the bristles should have the layers bonded together. One means of achieving this bonding is by pressure bonding (also known as mechanical quilting) of the type typically used to bond multiple plies of paper towels together. The same compression force that creates the bonding can also create the undulations. An alternative is to use a water-dissolvable adhesive such as adhesive H9397 (a hot melt adhesive sold by Bostik Findley), or water-dissolvable threads or staples made of a material such as polyvinyl alcohol.

It is preferred that the rear end be compressed such that at rest the bristle front end will be between 50 and 200% thicker than the part with undulations. When this is the case, the bristle end will tend to spread out/flower the appropriate amount when pushed against the bowl side during a scrubbing motion.

It is preferred for the undulating section to constitute no more than one-half of the head axial length. This permits at least one-half of the length to be used for bristles and spreading support therefor. It is also preferred for there to be between two and twenty undulations on a side, most preferably between five and ten, even more preferably about seven.

In other forms the brush head will be at least partially impregnated with a cleaning chemical such as a surfactant. The chemical might be a mixture of one or more of surfactants known to be effective for toilet bowl or other cleaning (for example most preferably anionic and nonionic in combination, but also possible cationic or zwitterionic). The chemical composition can also include fragrance, dye (for example to dye the head itself or for turning the bowl water a desired color such as blue), preservatives, bleaches, and/or other additives conventional in toilet bowl cleaners (for example abrasives).

Most preferably, any such impregnating chemical will only have a very low percentage, or no, water. For example, the chemical composition could, as applied, have less than 30% water. By using low levels of (or no) water in the cleaning chemical, the cleaner is inhibited from migrating during storage from the interior layers to the exterior layers. Further, the structural integrity of the brush is protected.

The stack is preferably cut at the forward end with parallel cuts to create bristles. Each bristle could be single-layered, or more preferably be at least a double-layered structure in the form of a loop.

The present invention advantageously provides in various embodiments:

a cleaning implement;

a brush head of the above kind that has a relatively stiff rearward portion such that force applied to the rear of the brush head via the brush handle will be efficiently transmitted to the brush head bristles to assist scrubbing;

a brush head of the above kind that can easily be securely mounted in a jaw of a holding wand;

a wand of the above kind that can securely hold such a brush head; and toilet brushes which can be formed from such wands and brush heads that are inexpensive to produce.

These and still other advantages of the present invention will be apparent from the following disclosure. In the following description reference is also made to the accompanying drawings which form a part thereof, and in which there is shown by way of illustration preferred embodiments of the invention. These embodiments do not represent the full scope of the invention. Rather, reference should be made to the claims herein for determining the full scope of the invention.

DETAILED DESCRIPTION OF THE INVENTION

Figure 1:
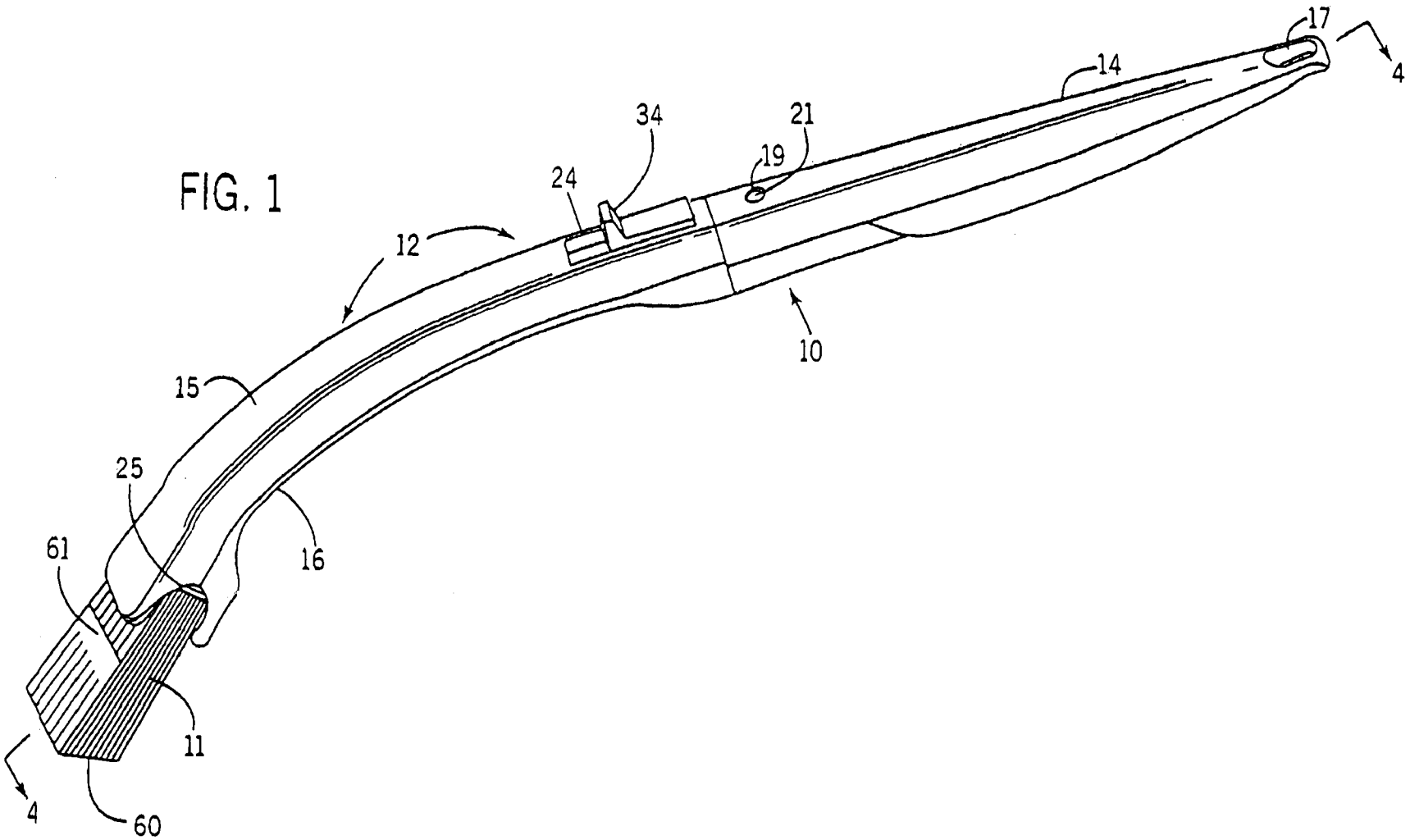
FIG. 1 is a top, frontal, right perspective view of an assembled toilet brush of the present invention.
Figure 2:
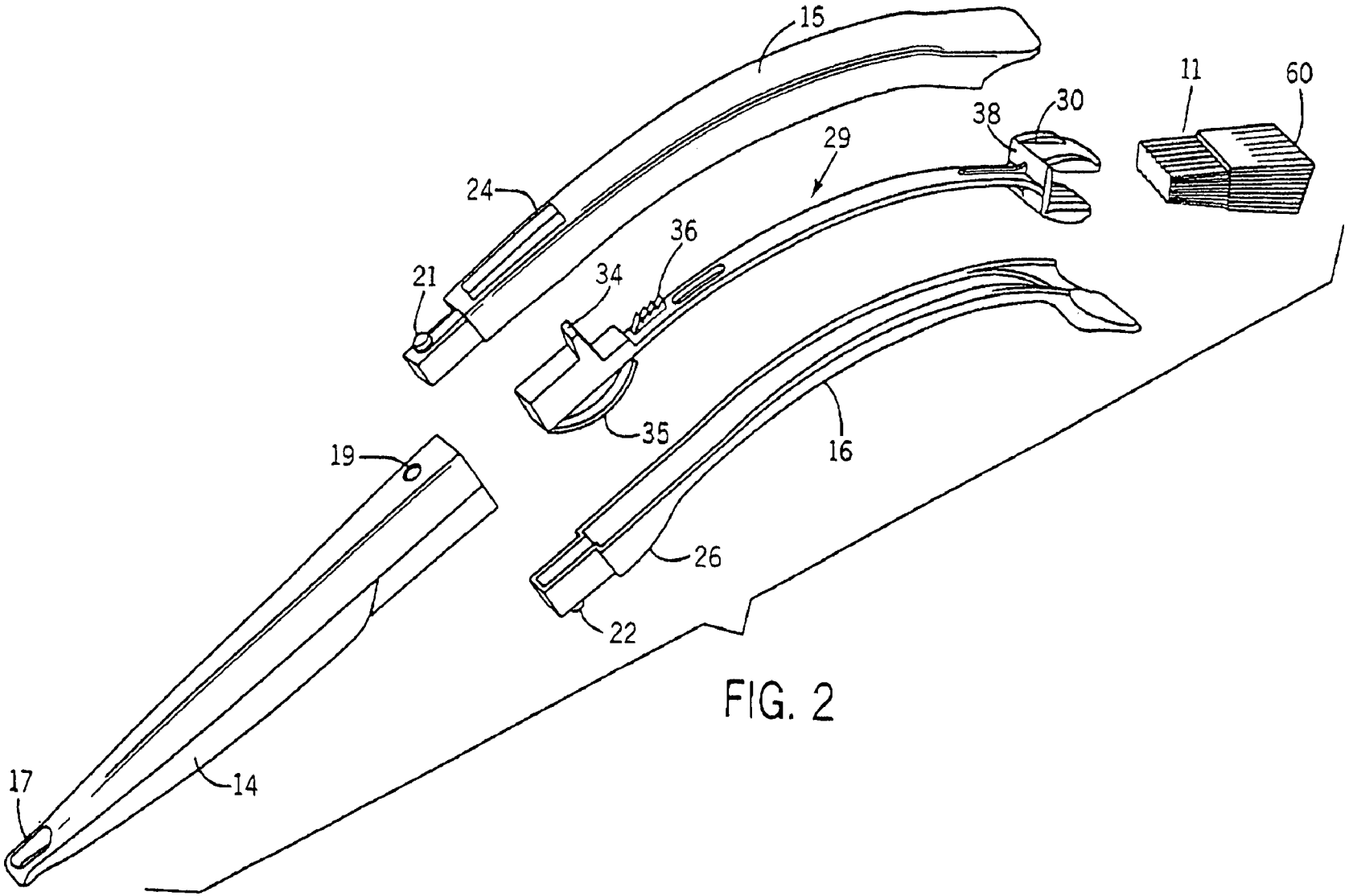
FIG. 2 is an exploded perspective view thereof, albeit taken from the left side.
Figure 3:
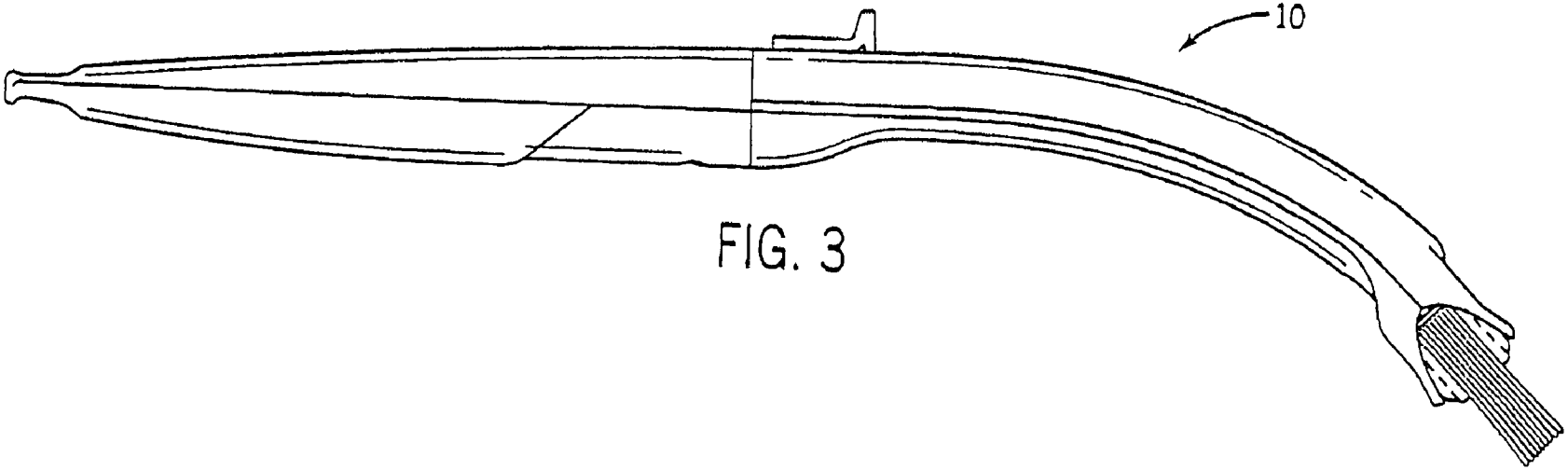
FIG. 3 is a left side elevational view of the FIG. 1 brush.
Figure 4:
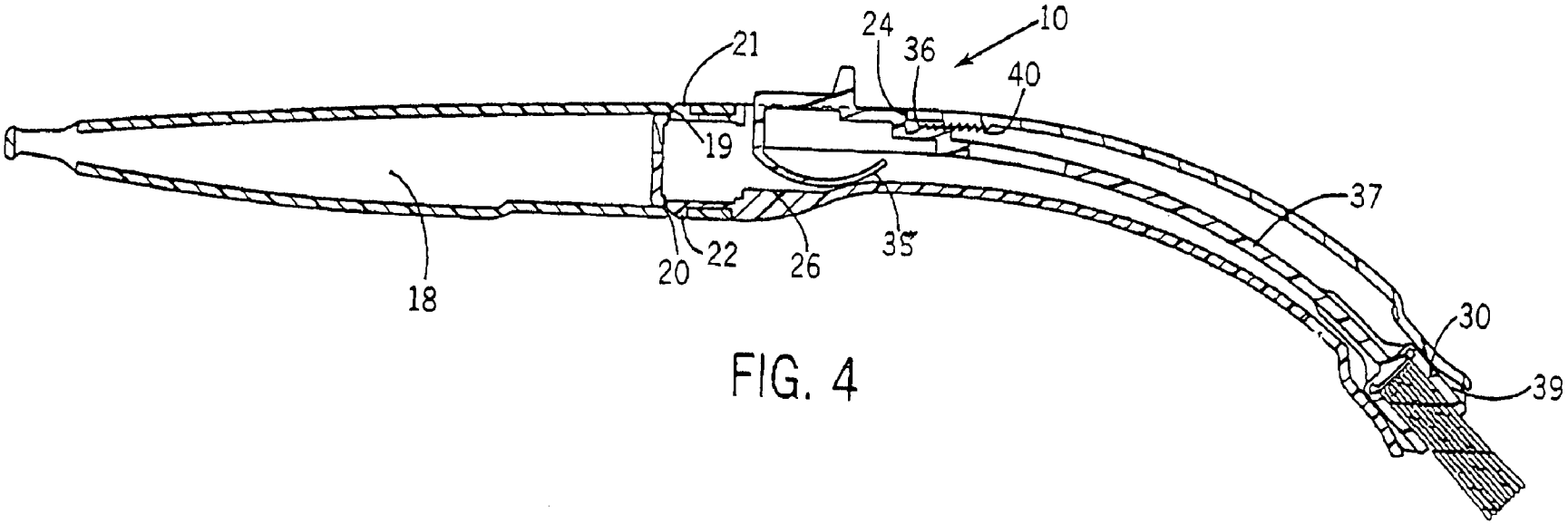
FIG. 4 is a cross sectional view taken along line 4-4 of FIG. 1.

In FIGS. 1-6 there is depicted a toilet brush (generally 10) having a disposable brush head 11 and a multi-part wand/handle (generally 12). FIGS. 2 and 4 depict that the wand 12 can be assembled from an extension 14, and upper and lower clam shell housing parts 15 and 16. The extension 14 is preferably largely hollow to reduce weight, and is formed with a hole 17 for assisting in hanging up the wand 12 (or the wand 12 with an unused brush head 11 connected thereto) between uses (for example on a nail or a hook).

Near the opposite end of the extension 14 are radially extending holes 19 and 20 that are suitable to receive corresponding snap parts 21 and 22 of the housing parts 15 and 16. The housing part 15 has a radial slot 24 on one surface and an arcuate inner channel along its opposite surface. The housing part 16 has a corresponding arcuate inner channel along its upper surface extending to a rear depressed area 26. When the housing parts 15 and 16 are assembled together, they form a somewhat clam shell-like housing with a hollow internal cavity communicating with the slot 24 and a mouth outlet 25 at a lower end.

Prior to assembling the housing parts 15 and 16, an actuator (generally 29) is positioned there between. As shown in FIG. 2, the actuator 29 has a radially outward projecting section 34, a lower flexible spring 35, a series of catch teeth 36, a rod 37 (which is preferably of a cross-shaped cross section to reduce weight and friction), and a flexible jaw 38 having one or more abutment ears 39.

The projection 34 extends through the slot 24, with the spring 35 then abutting housing part 16. From FIG. 5 it can be seen that corresponding teeth 40 are formed on an internal surface of housing part 15.

Once the parts 15 and 16 have sandwiched the actuator 29, that subassembly can be snap fit into the extension 14 via the interaction of the parts 19, 20, 21 and 22. This creates a secure and rigid wand structure.

Figures 5, 6:
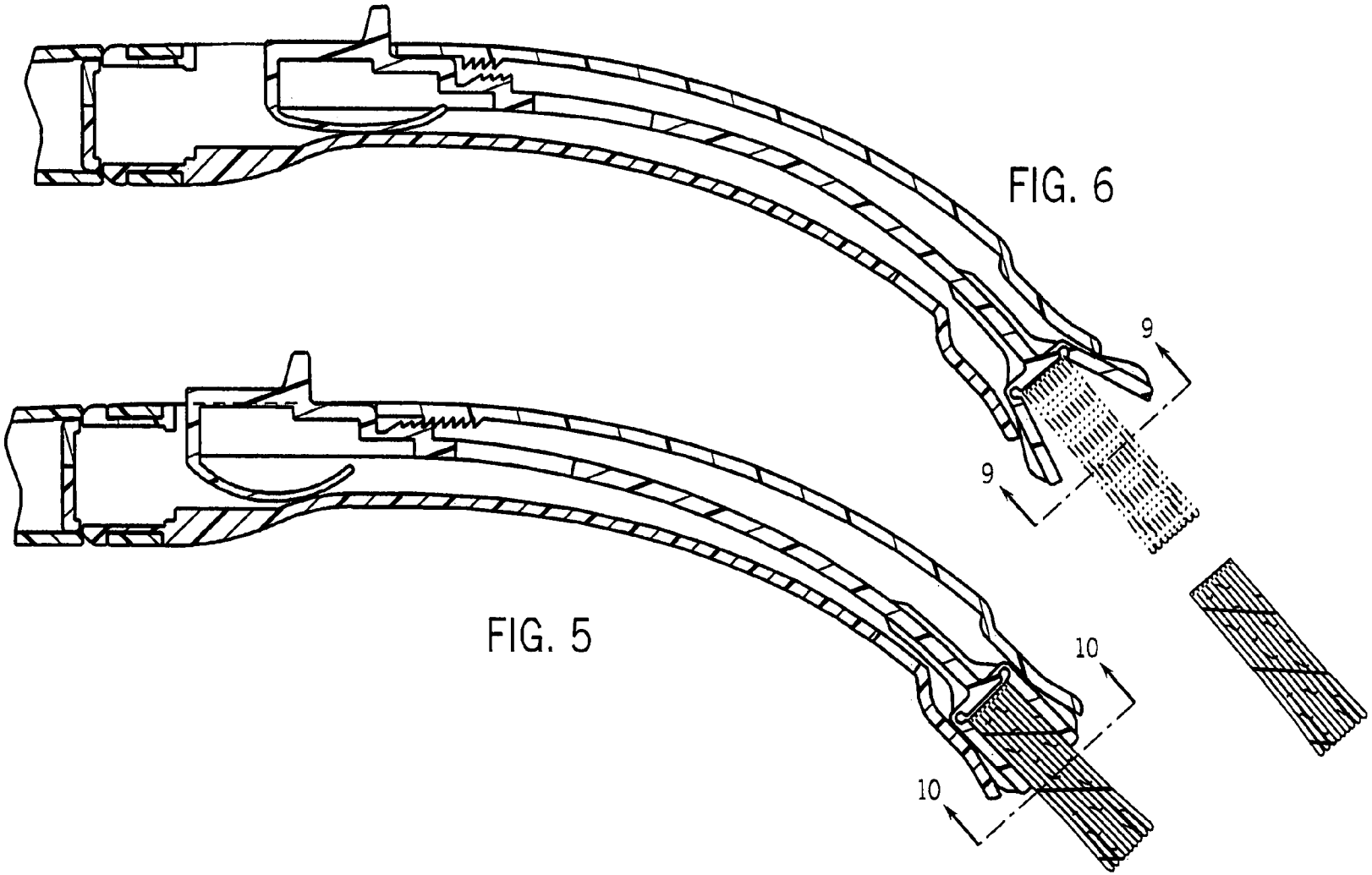
FIG. 5 is an enlargement of a portion of FIG. 4, showing the brush head in the clamped position.
FIG. 6 is a view similar to FIG. 5, but with the actuator moved such that the clamping jaw has flexed open to permit the release of the brush head.

When the projection 34 is in the FIG. 5 position, teeth 36 are interfit with the teeth 40 such that downward movement of the connecting rod 37 is inhibited. In this position the upper and lower jaws 30 have been driven by the mouth 25 firmly against the rearward portion of the brush 11 of the present invention.

In this configuration the jaws firmly hold the brush head 11, and the control rod 37 is inhibited from accidentally moving in a way that would permit release of the brush head. However, when a consumer pushes radially inward on the projection 34 (compare FIGS. 5 and 6) against the opposing spring pressure, the teeth 36 and 40 will clear each other (see FIG. 6) such that a consumer can then readily push the projection 34 axially towards the handle mouth. Subsequent release of the projection permits the teeth to re-engage.

The actuator 29 is preferably molded from a plastic such as polypropylene which holds a position bias. The jaw portion thereof can be molded with a rest position that is more open than shown in FIG. 6. When the jaws are dragged into the wand mouth 25, they will tend to move towards each other as shown in FIG. 5. However, even a slight release of the wand holding pressure, as shown in FIG. 6, will allow the jaw to flex open, thereby releasing the brush head.

It is expected that the brush head will then be able to easily fall out of the jaw into the toilet bowl for flushing disposal. However, if the brush head tends to hold in place, one can lightly shake the brush head to dislodge it.

When it is desired to reclose the jaw to clamp a replacement brush head, simple axial movement of the projection 34 (without any depressing of it) will achieve this due to the particular sloping of the teeth. Thus, a unidirectional movement of the projection is sufficient to catch a new brush head, while a bidirectional movement is required to create a release. This helps avoid accidental release of the brush head, while making insertion of the replacement brush head easy and intuitive.

Wand parts 14-16 are preferably made of plastic. It is especially preferred that a more flexible plastic be used for actuator 29 than for the outer parts 14-16.

While parts 14-16 are shown as being linked together by a snap fit connection of a type conventional with vacuum cleaner hose parts, a variety of other mechanical means for securing the parts together are possible. For example, there may be some benefits to the use of a bayonet type connection, rather than a simple axial snap connection. Alternatively, the parts 14-16 could be reconfigured as a two-part clam shell, albeit this would be less preferred due to it taking up extra shelf and shipping space prior to purchase by the consumer.

Also, while teeth 36/40 are angled to render clamping of the brush head easier to achieve than release, the teeth could be otherwise angled. For example, rendering them normal to the wand would make it equally difficult to move the connecting rod 33 in either direction, and require radial motion for both to proceed.

Figure 7:
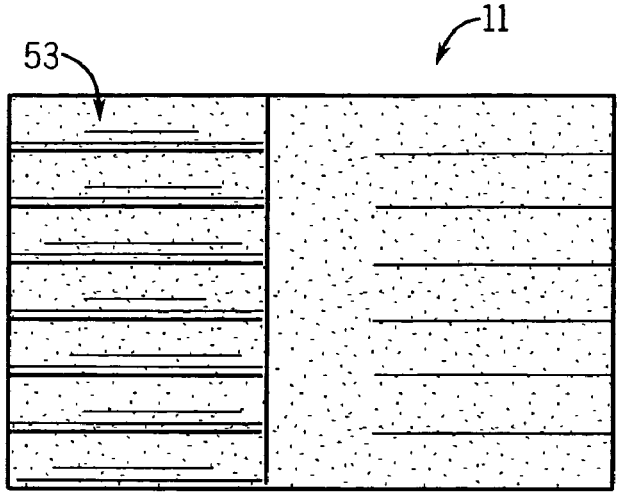
FIG. 7 is a top plan view of the brush head portion of the toilet brush.
Figure 8:
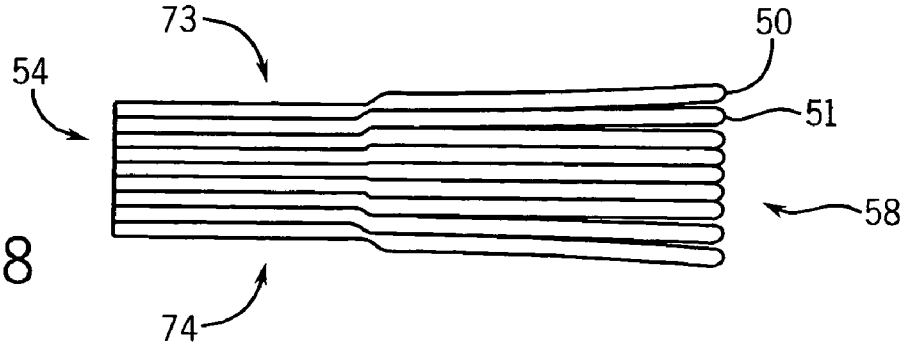
FIG. 8 is a side elevational view thereof.

Particularly now with respect to FIGS. 7 and 8, the brush head 11 is a stack of layers (50, 51, etc.) of water-degradable material. The layers may be folded back on each other once, and then stacked.

The stack has a series of undulations 53 at its rearward end 54 on both the top 73 and bottom 74 of the brush head. As will be described in more detail below, the undulations can be formed by a compression roller, with the pressure bonding the layers together in a manner similar to mechanical quilting. Where there are the undulations, the compression of the stack sufficiently bonds the layers of the stack together, while permitting the forward end 58 to flower outward.

Figure 9:
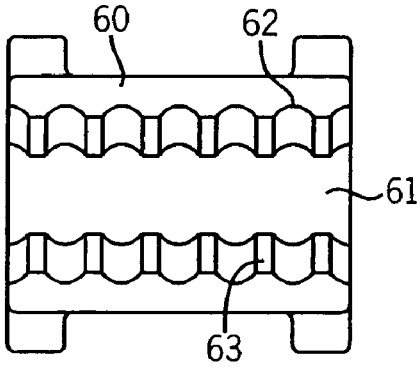
FIG. 9 is an end view of a slightly modified wand jaw.
Figure 10:
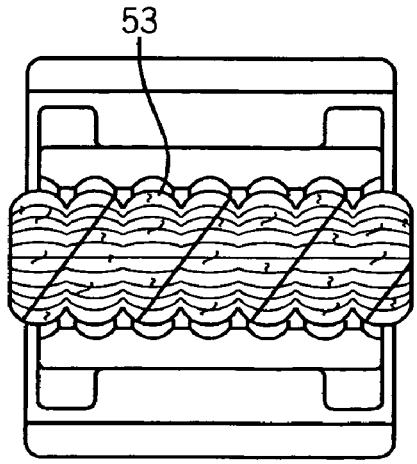
FIG. 10 is a view similar to FIG. 9, but with the FIG. 8 brush head inserted therein, with the brush head shown in section.

FIG. 9 shows a slightly modified jaw structure 60, with a mouth 61 defined by a series of generally parallel, longitudinal, two-part, almost cylindrical, openings 62 separated by narrowed linking openings 63. As best seen in FIG. 10, the presenting face of the jaw mouth thus acts to provide a corresponding reception area for the undulations 53. The undulations 53 and parallel cylindrical openings 62 provide an alignment device, while also controlling the type of refill used with the wand.

As the jaw tightens, it bites into the corresponding undulations. This provides an even more secure connection.

Figure 11:
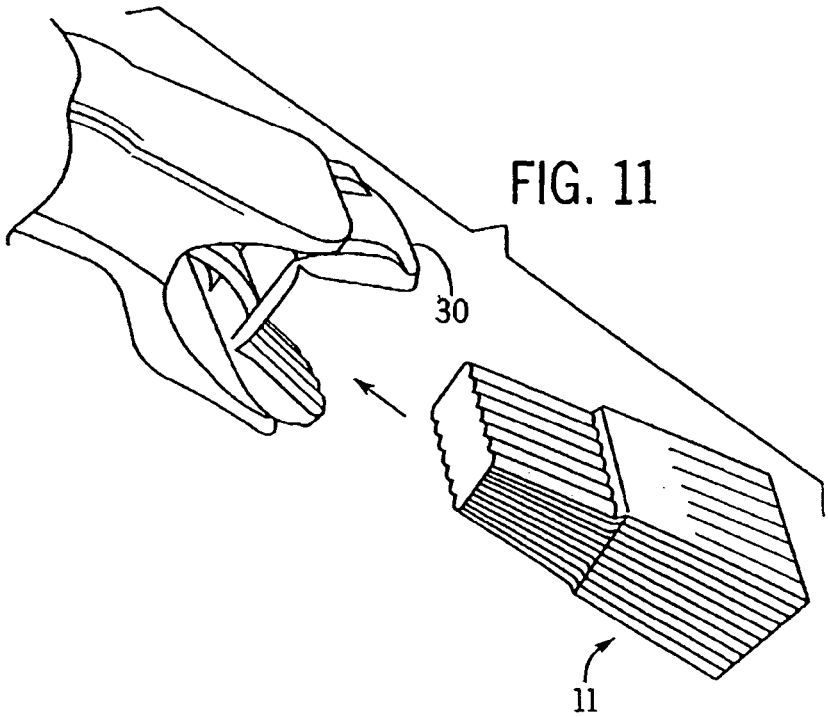
FIG. 11 shows the brush head of FIG. 1 in the process of being mounted into the wand jaw by movement along a longitudinal axis of the jaw.

FIG. 11 depicts a consumer beginning to attempt to insert the brush head 11 into the jaw 30.

Figure 12:
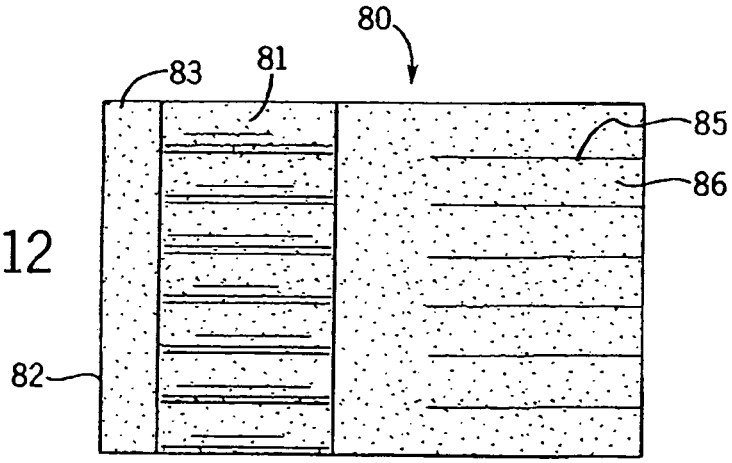
FIG. 12 is a view similar to FIG. 7, but of a modified embodiment of the brush head.

FIG. 12 shows a modified brush head 80 that is similar in all respects to the brush head 11, except that the undulations 81 do not extend all the way to the rear 82 of the brush head, and a slightly compressed, but not undulating, region 83 can be left at the rear of the brush head 80. Again, parallel slits 85 can be provided to create an array of bristles 86.

Figure 13:
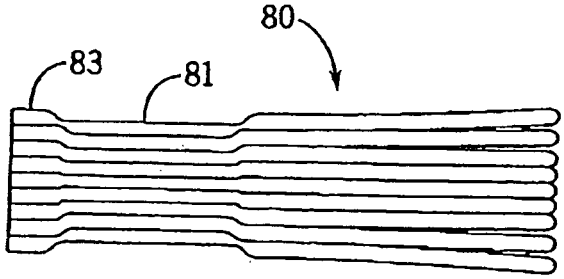
FIG. 13 is a view similar to FIG. 8, but of the FIG. 12 embodiment.

FIG. 13 shows the relative degree of compression of the respective sections, with region 83 preferably being at an intermediate level of compression relative to the most compressed area 81 and the non-compressed area of the bristles 86.

Figure 14:
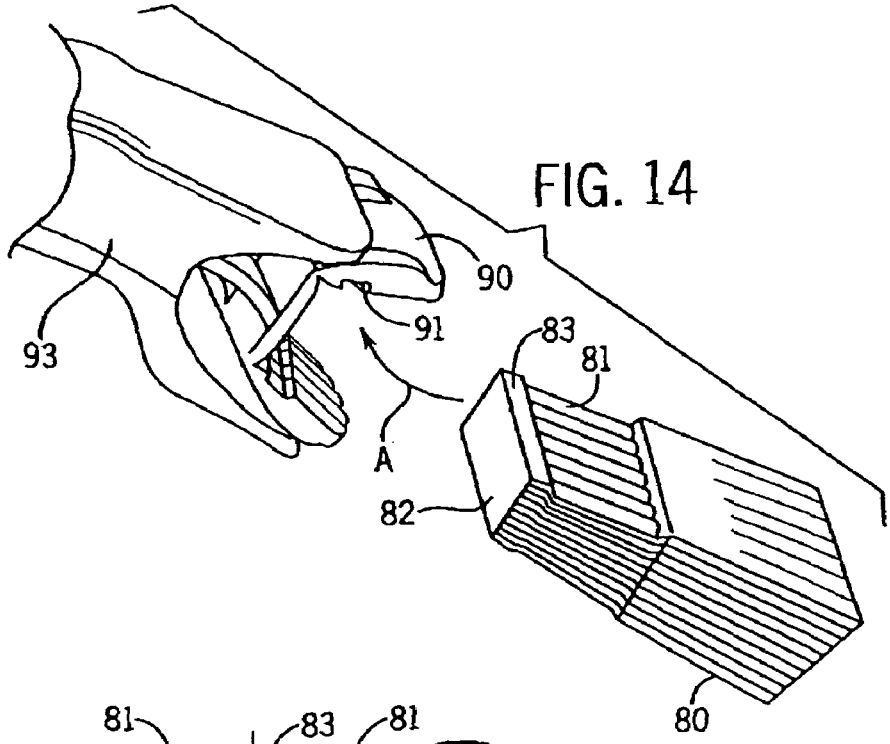
FIG. 14 shows the brush head of FIG. 12 in the process of being mounted into the jaw of a further modified wand assembly.

FIG. 14 shows that the parts could be configured so that the brush head 80 could similarly be longitudinally inserted into jaw 90 (in a manner analogous to how the parts can be assembled with respect to the FIG. 11 embodiment). However, it is preferable for this embodiment that the length of the connecting rod be such that even when the jaw is at its maximum open position, it won't open enough for the end 83 to pass longitudinally into the jaw.

Instead, in this configuration, one would need to slide the end 83 into side cheek holes 91, from the side, as indicated by the arrow A. After doing this, the head 80 cannot be simply moved longitudinally out the jaw 90. The jaw can then be clamped tightly against the head 83 to prevent removal out the side cheek opening.

This has several advantages. First, it insures that the brush head will always be inserted a sufficient distance so that it will be securely clamped. Further, it insures that brush heads not having this type of cross section, and of sufficient thickness, cannot be easily used with the brush wand 93.

Figure 15:
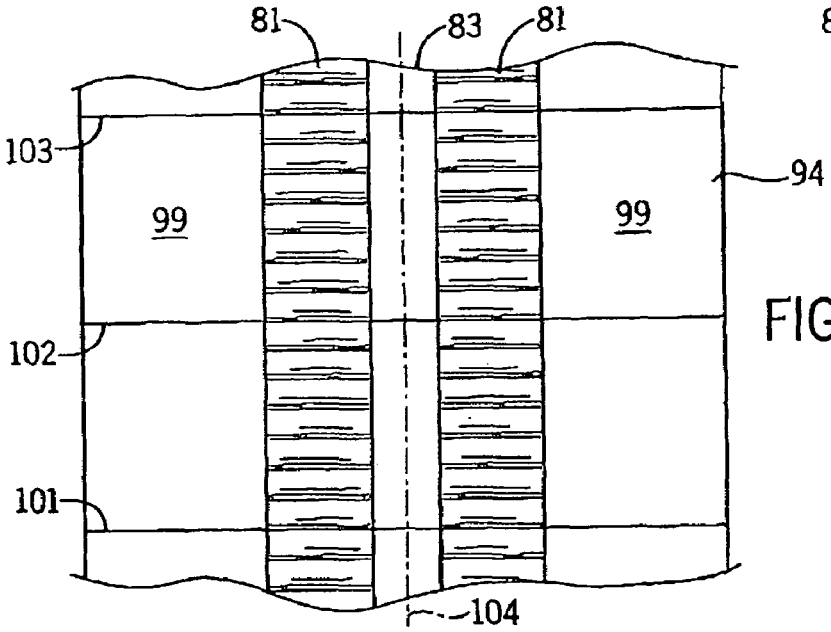
FIG. 15 is a top view of a fragment of a continuous stacked sheet of water-degradable paper that has been previously compressed by a roller in accordance with a preferred method of the present invention.
Figure 16:
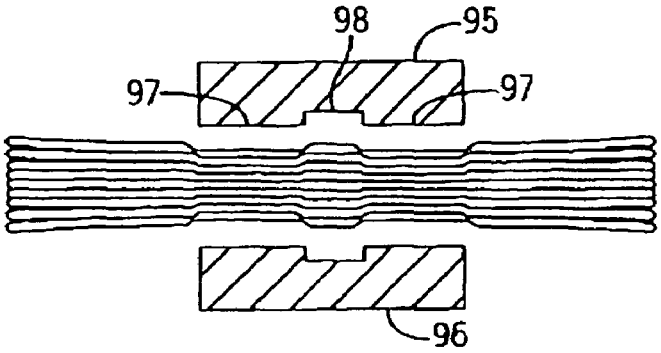
FIG. 16 schematically shows how the FIG. 15 structure can be created using a compression roller.

The brush head 80 can be manufactured in accordance with the method depicted schematically in FIGS. 15 and 16. One can take an elongated continuous stack of sheets 94 and then roll its top with a compression roller 95. At the same time, a roller 96 can roll its bottom.

Each roller has two wavy regions 97 sandwiching a non-wavy region 98. The rollers create two regions of highly compressed undulations 81 adjacent a middle slightly compressed continuous region 83. Outside regions 99 are not compressed.

One may then cut the material along transverse cut lines 101, 102, 103, etc., followed by a further cut 104, to thereby create a plurality of brush heads 60.

While specific embodiments of the invention have been described, additional embodiments are possible without departing from the spirit or scope of the invention. For example, the term "undulation" is not limited to just a smoothly contoured set of waves of uniform dimension. Rather, the undulations could be a series of pointed or more complex projections separated by recesses. Similarly, the cross section of the openings in the jaw need not be purely cylindrical.

As such, one skilled in the art will readily appreciate that still other alternative embodiments fall within the scope and breadth of the invention. The claims should be looked to in order to understand the full scope of the invention, and the claims are not to be limited to just the preferred embodiments shown.

INDUSTRIAL APPLICABILITY

An improved toilet brush is provided with an undulating brush head that is disposable and replaceable, in a wand having a complementary jaw.

We claim:

1. A cleaning implement, comprising:

a handle having a clamping jaw with a mouth and throat; and a brush head formed from a stack of water-degradable material so as to be suitable to be held in the jaw with a portion in the throat, wherein the brush head has a series of undulations extending along a longitudinal axis of at least one of its top or bottom surfaces and the brush head having a narrowed middle portion having said undulations and having a thickened rearward end;

wherein the mouth has a having means to secure the brush head and inhibit side-to-side movement of the brush head in the mouth when the jaw is fully closed;

wherein said means to secure are a series of essentially parallel openings, where a plurality of the openings have the characteristic of extending along the longitudinal axis of the brush head, and along a longitudinal axis of the jaw, wherein at least two of those openings having that characteristic are separated by a narrowed linking opening;

wherein the undulations extend along a longitudinal axis of the brush head, beginning adjacent, but not at, a rearward end of the brush head; and wherein the jaw has a side cheek opening linked to the throat that is suitable to permit the rearward end of the brush head to be slid into the cheek opening from a side of the jaw when the jaw is partially closed to an extent that inhibits the rearward end of the brush head from thereafter being slid out of the jaw in a direction from the throat towards the front of the jaw.

2. The cleaning implement of claim 1, wherein the brush head is formed with a front flowerable end.

* * * * *